United States Patent [19]

Stachnik

[11] 4,418,479

[45] Dec. 6, 1983

[54] VARIABLE RANGE SIGHTING MECHANISM FOR USE WITH ARCHERY BOW

[76] Inventor: John Stachnik, R.D. #2, Box 166, Susquehanna, Pa. 18847

[21] Appl. No.: 946,195

[22] Filed: Sep. 27, 1978

[51] Int. Cl.[3] ..... G01C 15/12; F41G 1/46

[52] U.S. Cl. ..... 33/265

[58] Field of Search ..... 33/265, 258; 124/87

[56] References Cited

U.S. PATENT DOCUMENTS

| | | | |
|---|---|---|---|
| 2,600,801 | 6/1952 | Pasquarella | 33/258 |
| 3,058,221 | 10/1962 | McNeel | 33/265 |
| 3,487,548 | 1/1970 | Frydenlund | 33/265 |
| 3,488,853 | 1/1970 | Altier | 33/265 |
| 3,666,368 | 5/1972 | Sprandel | 33/265 |
| 4,159,575 | 7/1979 | Kalmbach | 33/265 |

*Primary Examiner*—Steven L. Stephan

[57] ABSTRACT

A sighting mechanism for attachment to an archery bow or the like is adapted to provide accurate sighting in a number of ranges by an adjustment mechanism which changes the angle of elevation of a sight bar according to the desired range. A rear sight such as a V or peep may be moved back and forth in the sight bar to correct for wind conditions. Alternatively, the entire sight bar may be pivotally mounted at or near its center point so that it will swivel to allow for wind conditions.

4 Claims, 8 Drawing Figures

VARIABLE RANGE SIGHTING MECHANISM FOR USE WITH ARCHERY BOW

BACKGROUND OF THE INVENTION

Present invention relates to a sighting mechanism for use with an archery bow and more particularly to a manually adjustable sighting mechanism for aiming an arrow or similar projectile.

In the prior art, there are a number of sighting devices for use with archery bows and arrows.

A devise shown in U.S. Pat. No. 2,574,599 employs a number of vertically spaced slots in a sighting mechanism wherein the slots are placed at calibrated intervals to permit the archer to properly aim the bow and arrow for the selected shooting distance. The mechanism shown in this patent has the disadvantage that the archer must aim through a different one of the slots for each selected distance and leave the possibility that he may not be aiming through the proper slot because of the easy confusion between closely spaced slots.

U.S. Pat. No. 3,505,985 shows an archery bow including a manually adjusted sighting mechanism including a trajectory scale and a unilateral adjustment to accommodate for wind condition. This patent requires that the archer loosen and adjust a sight bracket and retighten a clamping knob for each selected shooting distance. The mechanism does not readily adapt to quick change to a first range to a second range without taking an excessive amount of time to readjust the sight bracket. An adjustment for wind condition is made by moving the front sight or bead laterly to cause the archer to adjust the position of the bow to correct for wind condition.

U.S. Pat. No. 3,667,444 shows yet another archery bow with sighting mechanism. The sighting mechanism according to this patent is directed primarily to the use of an optical sighting device such as a telescopic sight. The patent does not teach a manually adjustable variable range sighting mechanism.

Yet another adjustable archery sight is shown in U.S. Pat. No. 3,674,002. This patent shows an adjustable sight which includes a cable driven front sight which is moved up and down to change the angle of attack of the bow by the adjustment of a drum or reel mounted on the back of the bow. This adjustable sight does not provide for a quick positive range change but requires the archer to make an analog judgement as to the position of the sight along the vertical bar.

Another prior art adjustable bow sight mechanism is shown in U.S. Pat. No. 4,026,032. This patent shows a sighting mechanism in which a number of vertically spaced pins are mounted in horizontal position having a bead at one end thereof and being threaded so that they may be adjusted in the horizontal plane for wind condition. The sighting mechanism of this patent, leads to ambiguity since it is possible for the archer to sight on an incorrect one of the number of vertically spaced beads thus resulting in improper range selection and inaccurate aiming of the arrow.

There are of course many other bow sight mechanisms which have not been discussed above. However, most of the other mechanisms do not provide a quick change manual adjustment for range with a positive detent action at a number of pre-selected ranges.

SUMMARY OF THE INVENTION

Therefore, it is an object of the present invention to sight a bow and arrow at a target at one of a number of preselected distances, with an adjustable sighting mechanism which is sturdy, and manually adjustable between a number of preselected positive detent positions.

It is another object of the present invention to sight a bow and arrow as above with a digitally adjustable sight mechanism having a sight bar adjusted for elevation by a finger control trigger which moves the sight bar between a number of pre-selected indented positions representive of shooting distance ranges.

It is yet another object of the present invention to sight a bow and arrow as above and wherein the sighting mechanism includes means for adjusting the sighting bar laterally to correct for wind condition.

It is yet a further object of the present invention to sight a bow and arrow as above wherein correction for wind condition is accomplished in moving a rear sight such as a V or peep sight laterally in a slot and located by a set screw or similar device.

Accordingly, the present invention in an adjustable sighting mechanism for bow and arrow includes a mounting plate for attaching the sight mechanism to an archery bow, a sight bar pivotally mounted to the mounting plate at a point along the sight bar, an arm connecting a sight bar to an adjustment mechanism, and an elevation plate pivotally mounted on said mounting plate and adjustably to said arm for adjusting the elevation of said sight bar between a number of predetermined indented positions representing shooting distances of said bow.

The present invention has the advantage that sight adjustment between a first selected range such as 25 yards and a second selected range such as 50 yards or a third selected range such as 75 yards can be made instantly by slight finger pressure of the archer without the archer removing his grip from the bow.

These and other objects, features and advantages of the present invention will become apparent by reference of the following description and to the accompanying drawing.

DETAILED DESCRIPTION OF THE INVENTION

In the sport of archery, whether the interest of the archer be in bow hunting or in target shooting, there is generally a need for a sighting mechanism which is readily adjusted for different ranges. Especially in bow hunting, the range adjustment is important since the archer must close to within a relatively short distance of the game and there being a significant difference in elevation of the arrow tip required for various distances when compared to rifle hunting due to the much lower projectile volicity of the bow and arrow system.

Therefore, a bow sight mechanism which is quickly and positively adjustable between a group of predetermined distances is a great aid to the archer.

Figure 1:
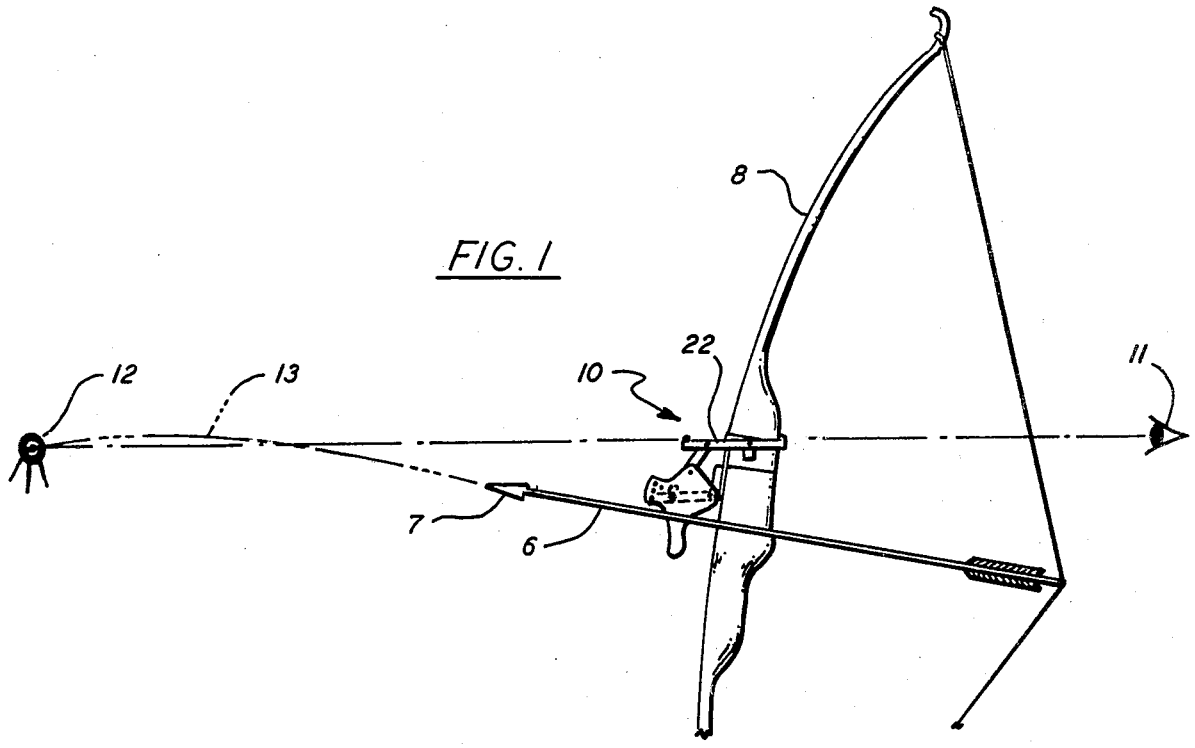
FIG. 1 is a perspective side view of a bow and arrow including a sighting mechanism according to a preferred embodiment of the present invention.

Referring now to FIG. 1, bow 8 having mounted thereon sighting mechanism 10 according to the present invention is in a full drawn position with arrow 6 having its point 7 elevated in accordance with the line of sight from the eye 11 of the archer to the target 12. Since the arrow will begin to fall to the Earth due to the force of gravity immediately after it is released must be shot in an upward arc to hit a target 12 at some distance. The trajectory 13 of the arrow indicates this upward mark. The line of sight 14 from the eye 11 of the archer along the sight bar 22 of sighting mechanism 10 to target 12 is a straight line which is adjusted to take into consideration the necessary angle of elevation of the tip 7 of arrow 6 to properly hit target 12.

It can be seen that as the target distance of the bow increases arrow 6 must be shot through a greater arc therefore bow 8 must be elevated at a greater angle. This is accomplished by causing the sighting mechanism 10 to move the front end 23 of sight bar 22 down as the desired shooting distance is increased. Similarly, if the desired shooting distance is decreased, sight bar 22 is raised thus allowing the archer to shoot with bow 8 at a lesser angle with the verticle end arrow 6 flying through a lower arc to reach target 12.

Figure 2:
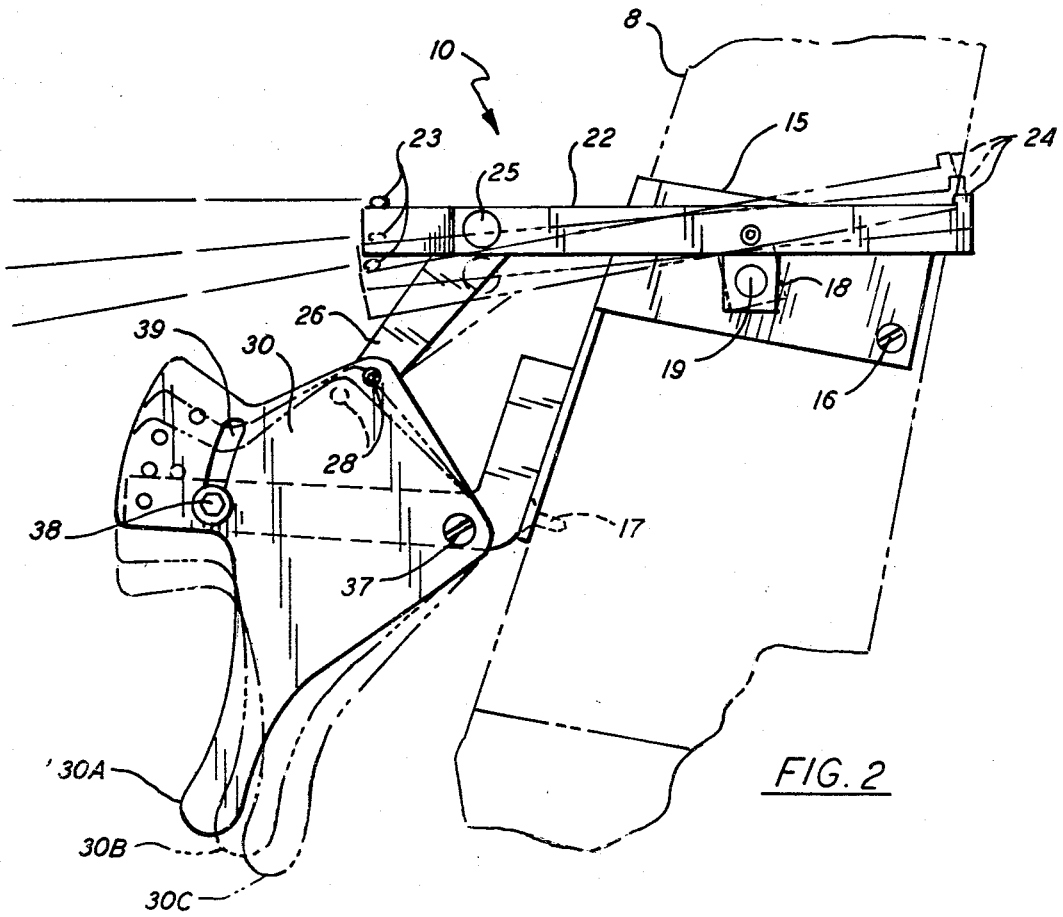
FIG. 2 is a side plan view of a sighting mechanism according to a preferred embodiment of the present invention showing three adjustment position of the mechanism.
Figure 3:
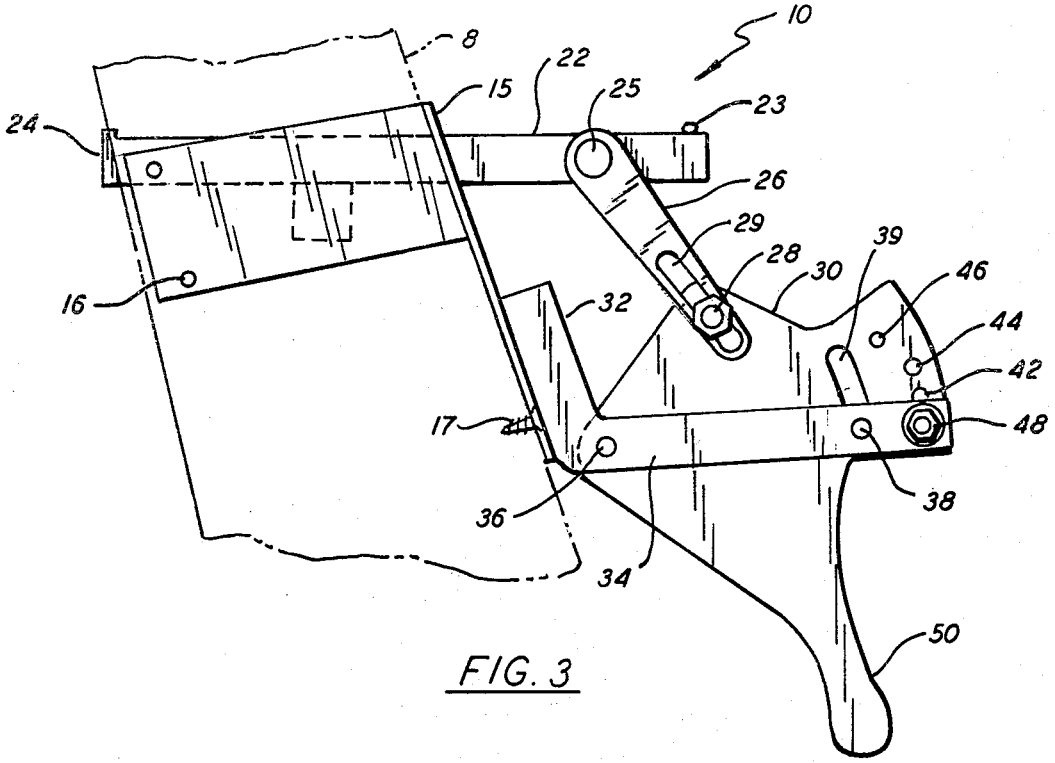
FIG. 3 is a right side plan view of a preferred embodiment of a sight mechanism according to the present invention.

Referring now to FIG. 2 a left side plan view of an adjustable sighting mechanism according to the present invention will be described. Sighting mechanism 10 is mounted to bow frame 8 by mounting bolt 15 by screws at points 16 and 17. Sight bar 22 having a bead sight 23 at the forward end thereof and a V sight 24 at the rear end thereof is pivotally mounted to mounting plate 15 by stand off 18 and mounting bolt 19. Adjustment arm 26 is attached to sight bar 22 at point 25 (See FIG. 3).

Elevation plate 30 is attached to arm 26 by bolt 28 in slot 29 in arm 26. Slot 29 is provided for initial adjustment of sighting ranges. Once the sighting mechanism have been initially adjusted, bolt 28 is tightened thus fixing the position of arm 26 relative to elevation plate 30. Elevation plate mounting arm 32 is attached to mounting plate 15 by any number of suitable methods including machine screws at spaced apart points or by welding to mounting plate 15. Elevation plate mounting arm has a short portion thereof which is mounted to the sight mechanism mounting plate 15 and in an elongated portion 34 which elevation plate 30 is attached. Elevation plate 30 is pivotally mounted to mounting arm 34 at point 36 by bolt 37. A second mounting point is at bolt 38 which engages slot 39 in mounting plate 30. Slot 39 is cut in an arc to permit rotation of plate 30 about point 36.

Elevation plate 30 has a number of holes 42, 44 and 46 therein which are cut along an arc having a locus at mounting point 36. Holes 42, 44 and 46 respectively are positioned to provide proper elevation of sight bar 22 for shooting distances of 25 yards, 50 yards and 75 yards respectively. Spring loaded detent mechanism 48 engages one of the holes 42, 44 or 46 to adjust the elevation of sight bar 22 for the selected shooting distance. Detent mechanism 48 is shown in greater detail in FIG. 5. Elevation plate 30 has an elongated portion thereof at the lower extremities 50 which is adapted to be operated at a lever by the archer to move the elevation plate so that detent mechanism engages one or the other of holes 42, 44 and 46 representing different shooting distances.

Referring again to FIG. 2, the three positions of elevation plate 30 representive of the pre-selected shooting distances of 25 yards, 50 yards and 75 yards are shown by the three dotted lines representations of elevation plate 30, respectively 30A, 30B and 30C.

Figure 4:
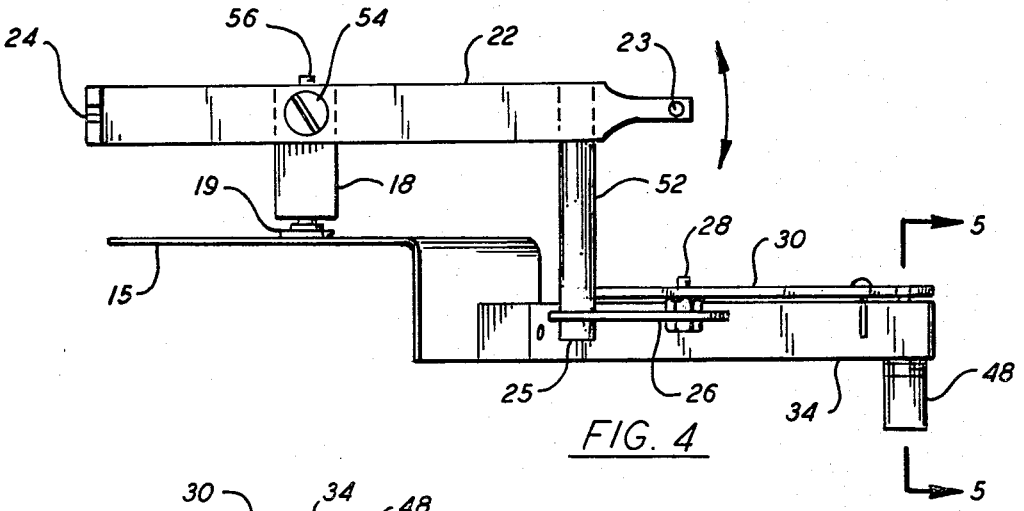
FIG. 4 is a top plan view of a sight mechanism according to an embodiment of the present invention showing the lateral adjustment of the sight bar for wind condition.

Referring now to FIG. 4, an embodiment of the invention including means for adjusting the lateral position of sight bar 22 to adjust for wind condition will be described. Sight bar 22 is mounted to mounting plate 15 by stand off 18 and mounting bolt 19 at a point near the center of sight bar 22 and by stand off 52 to arm 26 at point 25. The elevation of sight bar 22 is controlled by elevation plate 30 which moves arm 26 and thus through stand off 52 changes the elevation of sight bar 22.

To permit lateral adjustment of sight bar 22, the sight bar 22 is pivotally attached to stand off 18 by bolt 54 which is locked in place by locking said screw 56.

Since the arc through which sight bar 22 is normally rotated to correct for wind condition is less than 0.75 inches there will be no appreciable effect upon the elevation adjustment portion of the sighting mechanism due to changes in lateral position of sight bar 22.

Figure 5:
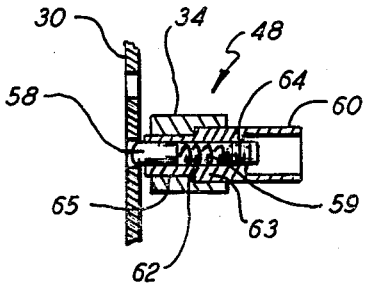
FIG. 5 is a section view of the spring loaded detent pin mechanism for positively locating the adjustment mechanism according to the present invention.

Referring now to FIG. 5, the spring loading detent mechanism which positively locates elevation plate 30 for each of the selected shooting distances will be described. Spring loading detent mechanism 48 is mounted in arm 34 which supports elevation plate 30. Pin 58 is forced by spring 59 into engagement with elevation plate 30. Since the pin 58 is placed in alignment with holes 42, 44 and 46 as plate 30 is rotated through an arc to change the elevation of sight bar 22, pin 58 will engage successively each of the holes 42, 44 and 46 representive of shooting distances 25, 50 and 75 yards in the current embodiment. Pin 58 and spring 59 are mounted in a cilander 62 in housing 60. Housing 60 may be attached to arm 34 by an internally threaded portion 63 which is threaded on to matching portion 64 within hole 65 and arm 34.

Figure 6:
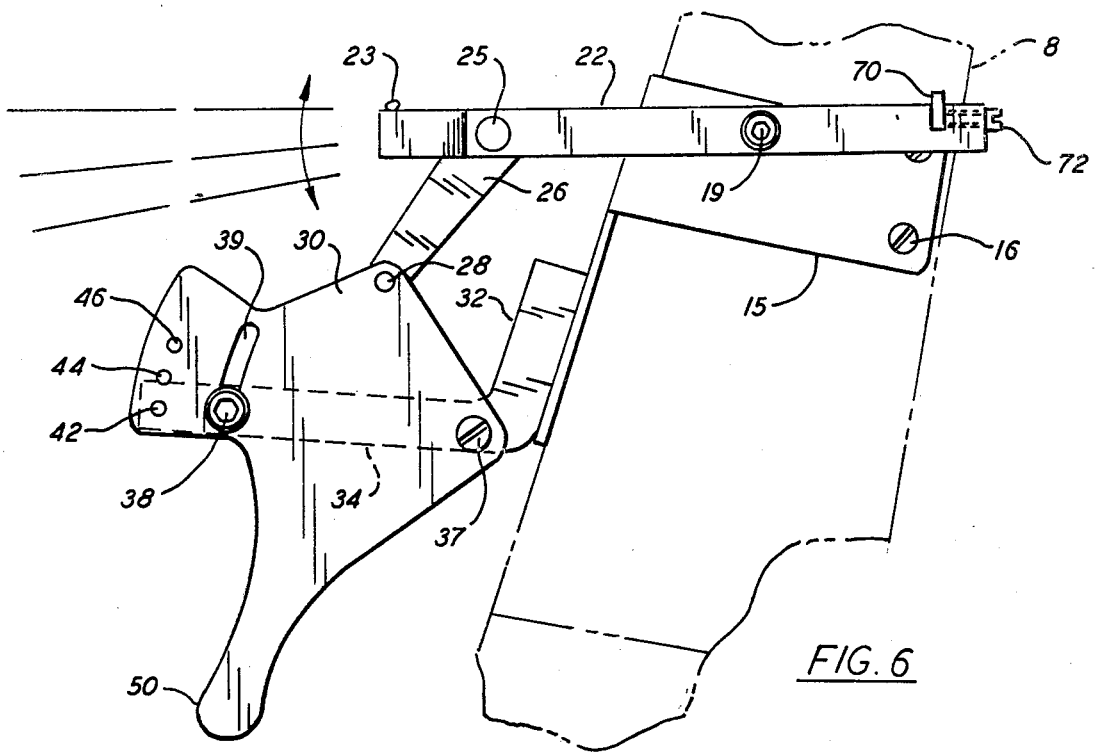
FIG. 6 is a left side plan view of a sight mechanism of an embodiment of the present invention wherein the elevation adjustment is at a first range and further showing a lateral adjustable rear V sight for adjusting the sight mechanism for wind condition.

Referring now to FIG. 6, an alternate embodiment of the present invention will be described in which correction for wind condition is made by adjusting the position of the rear V sight in a slot in sight bar 22.

Figure 7:
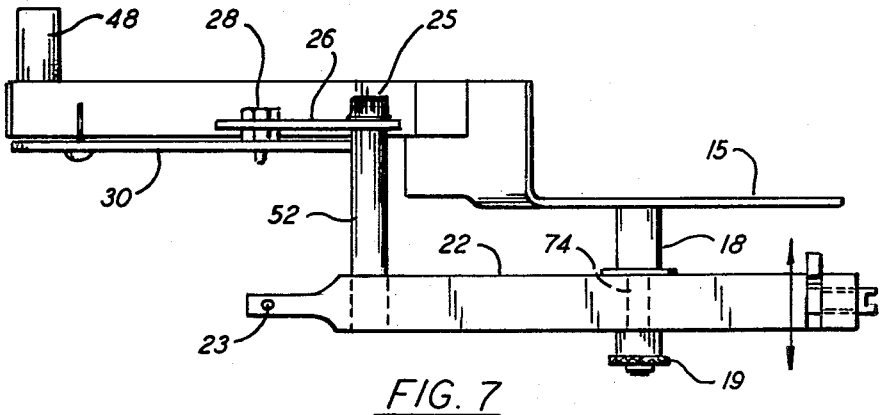
FIG. 7 is a top plan view of the embodiment shown in FIG. 6.
Figure 8:
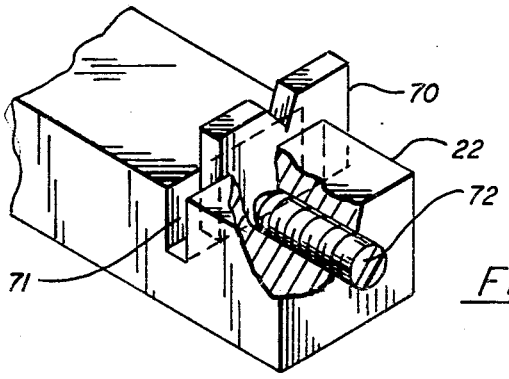
FIG. 8 is a perspective section view of the rear V sight according to the embodiment shown in FIG. 6 and FIG. 7.

In the embodiment of the present invention shown in respect to FIG. 6, the mechanism for adjusting the elevation of sight bar 22 is the same as has been previous discussed with reference to FIGS. 1–5. However, where in the previous embodiment stand off 18 and mounting bolt 19 were mounted below sight bar 22 to allow sight bar 22 to be pivoted about bolt 54, in the embodiment shown in FIG. 6, mounting bolt 19 passes through hole 74 in sight bar 22 thus providing a second point of support for sight bar 22 and preventing rotation of sight bar 22. Stand off 18 is mounted in line and surrounding mounting bolt 19 between sight bar 22 and mounting plate 15. In the following description of a second embodiment of the present invention, reference will be had to FIG. 6, FIG. 7 and FIG. 8.

A V sight is constructed of rectangular piece of metal having a V cut in one long edge thereof to provide the rear sight for the sighting mechanism. This V sight 70 is mounted in slot 71 cut across sight bar 22 near the rear end thereof. A set screw 72 is mounted from the back end of sight bar 22 to lock the sight 70 in desired position.

In the second embodiment of the present invention, the adjustment for wind condition is made by releasing set screw 72 from bearing on V sight 70, adjusting sight 70 to the proper position for the wind condition and tightening locking set screw 72 against V sight 70 to hold the V sight 70 in the proper position for the wind condition.

A sighting mechanism according to either embodiment of the present invention is rugged in construction, simple to use since the archer does not have to move his forward hand from the bow to change the elevation of the sight bar and the sighting mechanism is very simple in construction.

Although the invention has been described with reference to preferred embodiments thereof, it will be understood by those skilled in the art that various changes in the mechanism may be made without departing from the spirit or the scope of the invention.

What is claimed:

1. A sighting mechanism for use with an archery bow, comprising:

a mounting plate for mounting said sighting mechanism to said bow;

a sight bar having a front sight mounted on a forward portion thereof and a rear sight mounted on a rear portion thereof being adapted to be adjustable in one or more degrees of freedom;

means for attaching said sight bar to said mounting plate; and elevation adjustment means connected to said mounting plate and to said sight bar for adjusting the elevation of said sight bar with respect to said mounting plate for accurate shooting at one or more predetermined distances, said elevation adjustment means comprising a plate attached at a first point to said sight bar and at a second point pivotably mounted to said mounting plate and having a plurality of predetermined detent positions representative of preselected shooting distances for adjusting the angle of elevation of said sight bar.

2. A sighting mechanism according to claim 1 further comprises means for adjusting the lateral position of said sight bar to correct for wind condition.

3. A sighting mechanism according to claim 2 wherein said means for adjusting lateral position of said sight bar comprises means for pivotally mounting said sight bar to said mounting plate at a first point along said sight bar to allow said sight bar to be rotated about said point to correct for deviation of arrow flight due to wind condition.

4. A sighting mechanism according to claim 1 further comprising a rear sight slideable mounted said sight bar and locked in position by a locking device to permit adjustment of said sighting mechanism for wind conditions by moving said rear sight laterally in said sights.

* * * * *